US011322292B2

(12) United States Patent
Sugiyama et al.

(10) Patent No.: US 11,322,292 B2
(45) Date of Patent: May 3, 2022

(54) COIL COMPONENT

(71) Applicant: Murata Manufacturing Co., Ltd., Kyoto-fu (JP)

(72) Inventors: Mikito Sugiyama, Nagaokakyo (JP); Mitsuru Odahara, Nagaokakyo (JP); Takuya Ishida, Nagaokakyo (JP); Hideaki Ooi, Nagaokakyo (JP); Takao Kawachi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 640 days.

(21) Appl. No.: 16/213,947

(22) Filed: Dec. 7, 2018

(65) Prior Publication Data

US 2019/0221357 A1 Jul. 18, 2019

(30) Foreign Application Priority Data

Jan. 16, 2018 (JP) ..... JP2018-005082

(51) Int. Cl.
*H01F 27/02* (2006.01)
*H01F 27/28* (2006.01)
(Continued)

(52) U.S. Cl.
CPC ..... *H01F 27/2804* (2013.01); *H01F 1/12* (2013.01); *H01F 17/0013* (2013.01);
(Continued)

(58) Field of Classification Search
CPC .... H01F 27/2804; H01F 27/292; H01F 17/04; H01F 17/0013; H01F 1/12; H01F 27/02;
(Continued)

(56) References Cited

U.S. PATENT DOCUMENTS 8,975,997 B2 * 3/2015 Tonoyama ..... H01F 27/255 336/200
9,165,711 B2 * 10/2015 Lim ..... H01F 27/29
(Continued)

FOREIGN PATENT DOCUMENTS

JP H09-306715 A 11/1997
JP 2009-009985 A 1/2009
(Continued)

OTHER PUBLICATIONS

An Office Action mailed by the Korean Intellectual Property Office dated Feb. 11, 2020, which corresponds to Korean Patent Application 10-2019-0002797 and is related to U.S. Appl. No. 16/213,947.
(Continued)

*Primary Examiner* — Tuyen T Nguyen
(74) *Attorney, Agent, or Firm* — Studebaker & Brackett PC

(57) ABSTRACT

A coil component includes a body, a coil conductor embedded in the body, and outer electrodes disposed on the outside of the body. The body includes a first magnetic layer containing a substantially spherical metallic magnetic material and second and third layers containing a substantially flat metallic magnetic material. At least the wound section of the coil conductor is between the second and third magnetic layers in the direction along the axis of the coil conductor. In the direction perpendicular to the axis, the second and third magnetic layers have a width equal to or larger than the outer diameter of the wound section of the coil component. The substantially flat metallic magnetic material is oriented so that the flat plane thereof is perpendicular to the axis of the coil conductor. The first magnetic layer extends between the second and third magnetic layers and the outer electrodes.

20 Claims, 13 Drawing Sheets

(51) Int. Cl.

| | |
|---|---|
| ***H01F 1/12*** | (2006.01) |
| ***H01F 27/29*** | (2006.01) |
| ***H01F 17/04*** | (2006.01) |
| ***H01F 17/00*** | (2006.01) |
| *H01F 3/10* | (2006.01) |

(52) U.S. Cl.
CPC ..... *H01F 17/04* (2013.01); *H01F 27/02* (2013.01); *H01F 27/292* (2013.01); *H01F 2003/106* (2013.01); *H01F 2017/0066* (2013.01); *H01F 2017/048* (2013.01)

(58) Field of Classification Search
CPC ..... H01F 2017/0066; H01F 2017/048; H01F 2003/106; H01F 27/255; H01F 27/28; H01F 27/324
See application file for complete search history.

(56) References Cited

U.S. PATENT DOCUMENTS

| | | | | |
|---|---|---|---|---|
| 10,147,540 | B2 * | 12/2018 | Tonoyama | H01F 41/04 |
| 10,546,680 | B2 * | 1/2020 | Park | H01F 27/255 |
| 10,763,020 | B2 * | 9/2020 | Kobayashi | H01F 17/0013 |
| 2009/0002117 | A1 | 1/2009 | Kawarai | |
| 2013/0307655 | A1 | 11/2013 | Saito et al. | |
| 2016/0343498 | A1 | 11/2016 | Lee et al. | |
| 2016/0343506 | A1 | 11/2016 | Lee et al. | |
| 2017/0004915 | A1 | 1/2017 | Park et al. | |

FOREIGN PATENT DOCUMENTS

| | | | |
|---|---|---|---|
| JP | 2015-088522 | A | 5/2015 |
| KR | 2013-0139993 | A | 12/2013 |
| KR | 2016-0136127 | A | 11/2016 |
| KR | 2017-0004124 | A | 1/2017 |

OTHER PUBLICATIONS

An Office Action; "Notification of Reasons for Refusal," mailed by the Japanese Patent Office dated Mar. 10, 2020, which corresponds to Japanese Patent Application No. 2018-005082 and is related to U.S. Appl. No. 16/213,947 with English language translation.

* cited by examiner

COIL COMPONENT

CROSS-REFERENCE TO RELATED APPLICATION

This application claims benefit of priority to Japanese Patent Application No. 2018-005082, filed Jan. 16, 2018, the entire content of which is incorporated herein by reference.

BACKGROUND

Technical Field

The present disclosure relates to a coil component.

Background Art

Coil components, such as a choke coil, have used a substantially flat magnetic material to achieve higher magnetic permeability and higher inductance.

Japanese Unexamined Patent Application Publication No. 9-306715 discloses an electronic component consisting at least of a coil, a magnetic core, and electrodes. The magnetic core is a composite magnetic layer composed of an oxide-coated substantially flat and/or needle-shaped powder(s) of a soft magnetic material and an organic binder.

Japanese Unexamined Patent Application Publication No. 2015-88522 discloses an electronic coil that includes a magnetic section made of a soft magnetic metallic material, a coil conductor embedded in the magnetic section, and a pair of outer electrodes disposed on opposing sides of the magnetic section. The magnetic section contains, in at least part of its side portions, a substantially flat soft magnetic metallic material having a flattening of about 0.50 or more. The substantially flat soft magnetic metallic material is oriented in the direction of the coil axis.

The inventors studied these electronic components and found them disadvantageous in that a low specific electrical resistance of the magnetic layer made with a substantially flat magnetic material can cause short-circuiting between the outer electrodes and failed plating, such as unwanted plating spread during the formation of the outer electrodes.

SUMMARY

Accordingly, the present disclosure provides a coil component that is less likely to suffer short-circuiting between outer electrodes and failed plating and is improved in inductance.

The inventors found that putting a magnetic layer containing a substantially flat metallic magnetic material on top and bottom of a coil conductor, and placing a magnetic layer containing substantially spherical metallic magnetic material between the magnetic layers containing a substantially flat metallic magnetic material and the outer electrodes helps prevent short-circuiting between the outer electrodes and failed plating, such as unwanted plating spread during the formation of the outer electrodes, while improving the inductance of the coil component. Based on these findings, the inventors completed the present disclosure.

According to preferred embodiments of the present disclosure, a coil component includes a body, a coil conductor embedded in the body, and outer electrodes disposed on the outside of the body. The body includes a first magnetic layer containing a substantially spherical metallic magnetic material and second and third magnetic layers containing a substantially flat metallic magnetic material. At least the wound section of the coil conductor is between the second and third magnetic layers in the direction along the axis of the coil conductor. In the direction perpendicular to the axis, the second and third magnetic layers have a width equal to or larger than the outer diameter of the wound section of the coil conductor. The substantially flat metallic magnetic material, contained in the second and third magnetic layers, is oriented so that the flat plane thereof is perpendicular to the axis of the coil conductor. The first magnetic layer extends between the second and third magnetic layers and the outer electrodes.

Other features, elements, characteristics and advantages of the present disclosure will become more apparent from the following detailed description of preferred embodiments of the present disclosure with reference to the attached drawings.

DETAILED DESCRIPTION

Figure 1:
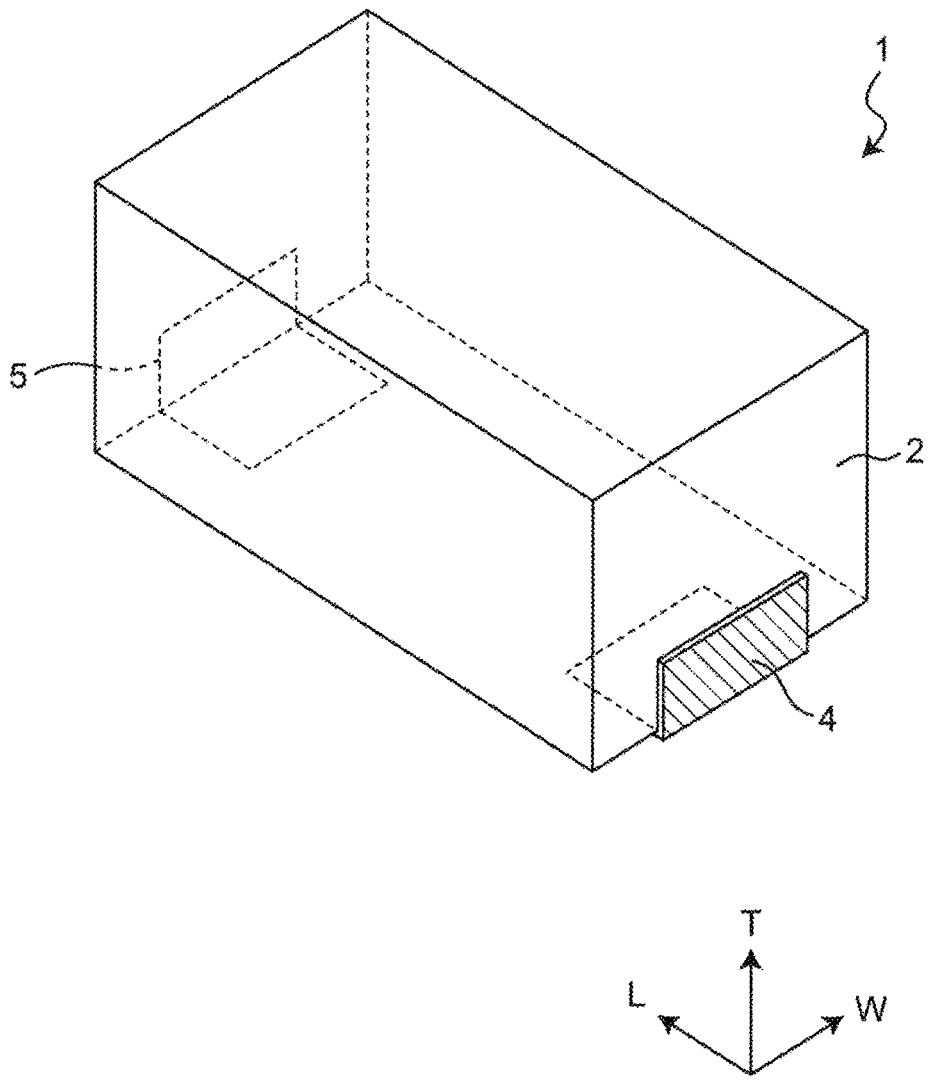
FIG. 1 is a schematic perspective view of a coil component according to an embodiment of the present disclosure.

The following describes coil components according to an embodiment of the present disclosure in detail with reference to the drawings. It is to be noted that the shapes, arrangements, and other details of a coil component according to an embodiment of the present disclosure and of its structural elements are not limited to the configurations described in the following embodiment or illustrated in the drawings.

A perspective view of a coil component 1 according to an embodiment of the present disclosure is schematically illustrated in FIG. 1. A perspective view of the body 2 of the coil component 1 is given in FIG. 2, with the internal elements illustrated visible. A cross-section of the coil component 1 is illustrated in FIG. 3.

Figure 2:
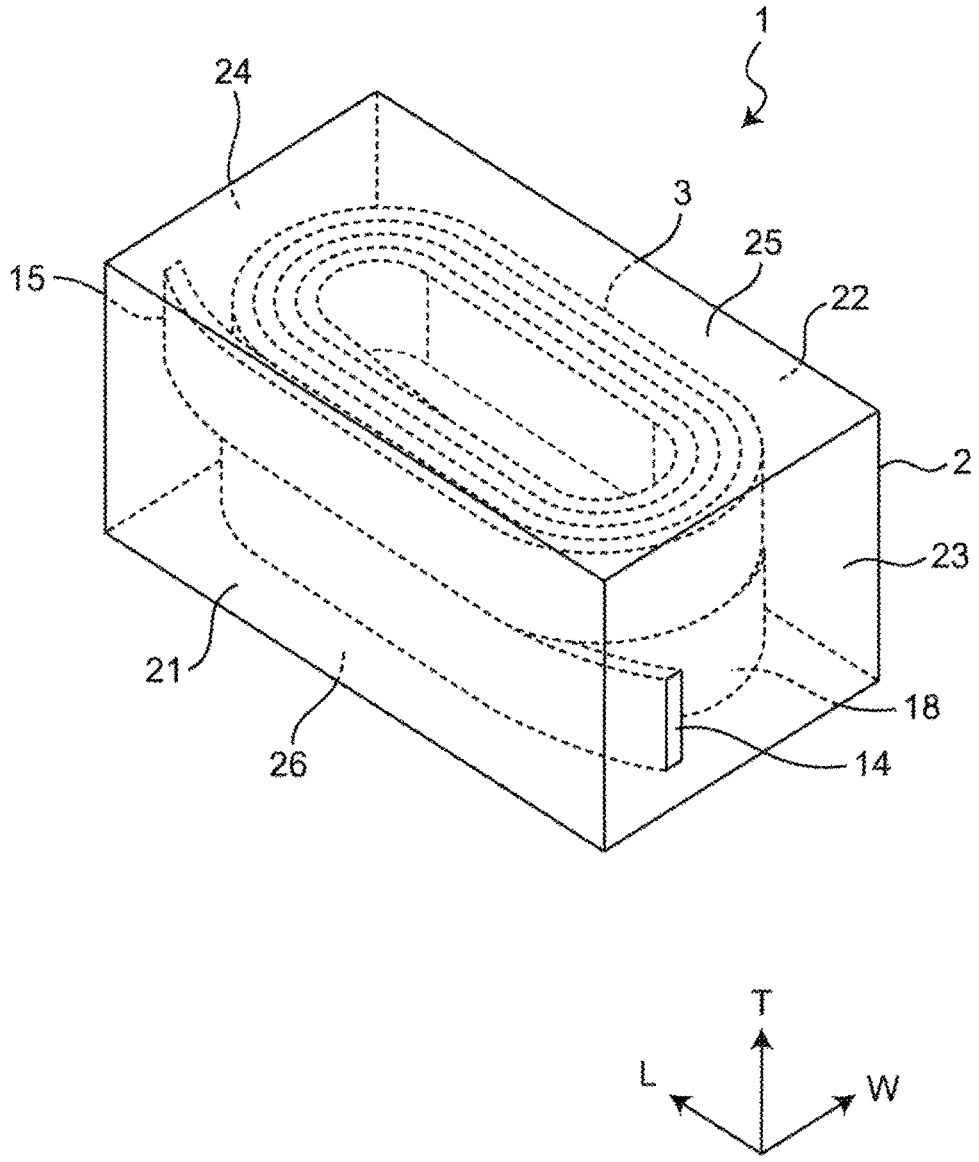
FIG. 2 is a perspective view of the coil component illustrated in FIG. 1, with the internal elements illustrated visible and the outer electrodes omitted.
Figure 3:
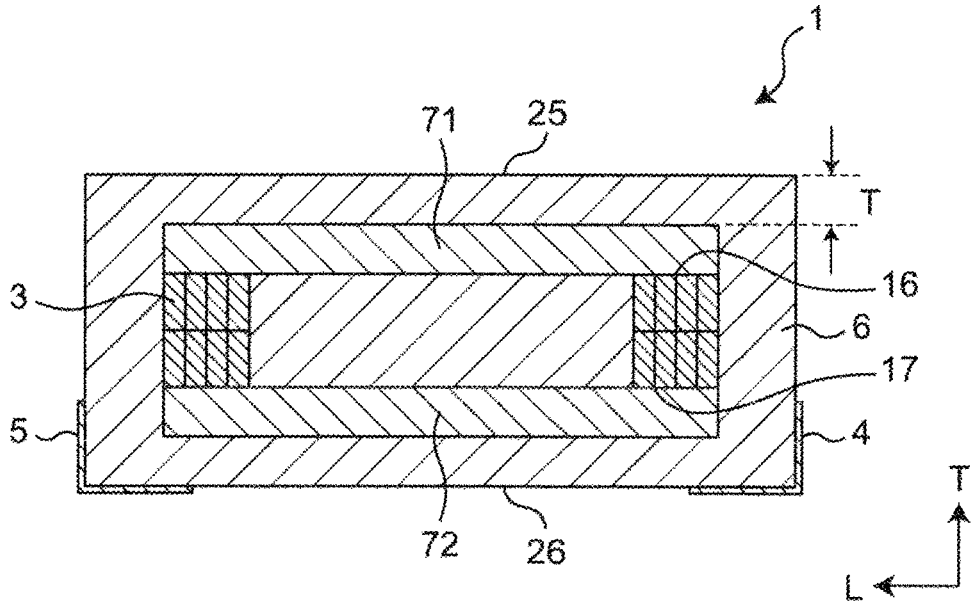
FIG. 3 is a cross-sectional view of the coil component illustrated in FIG. 1, schematically illustrating a cross-section parallel to the LT plane.

As illustrated in FIGS. 1 to 3, the coil component 1 according to this embodiment is substantially a rectangular parallelepiped. Major components of the coil component 1 include a body 2, a coil conductor 3 embedded in the body 2, and outer electrodes 4 and 5 disposed on the outside of the body 2. The surfaces of the body 2 on the left and right in FIG. 3 are referred to as the "end faces," the surface on top as the "top face," the surface on the bottom as the "bottom face," the surface at the front as the "front face," and the surface at the back as the "back face." Each of the end, front, and back faces may also be referred to simply as a "side." The body 2 includes a first magnetic layer containing a substantially spherical metallic magnetic material and second and third magnetic layers containing substantially flat metallic magnetic material. Inside the body 2 is embedded a coil conductor 3. The surface of the coil conductor 3 extending along the direction in which the wire is wound is referred to as the "side" of the coil conductor 3, and the surface extending along the direction of thickness of the wound wire as the "end faces" of the coil conductor 3. In this embodiment, the side 18 is formed by the primary surface of the outermost layer of the flat wire constituting the coil conductor 3 and is parallel to the axis of the coil conductor 3, and the end faces 16 and 17 are formed by the sides of each layer of the flat wire and are perpendicular to the axis of the coil conductor 3. The outer electrodes 4 and 5 are on the outside of the body 2 (end faces 23 and 24). In the configuration illustrated in FIGS. 1 to 3, the outer electrodes 4 and 5 extend from the end faces 23 and 24, respectively, of the body 2 to part of the bottom face 26. That is, the outer electrodes 4 and 5 are substantially L-shaped electrodes. It should be noted that the coil component 1 according to this embodiment is not limited to the shape and arrangement of the outer electrodes 4 and 5 illustrated in FIGS. 1 and 3. The ends of the coil conductor 3 (ends 14 and 15) are electrically coupled to the outer electrodes 4 and 5, respectively, at the end faces 23 and 24 of the body 2.

The length of the coil component 1 is herein denoted by "L", the width by "W," and the thickness (height) by "T" (see FIGS. 1 and 2). A plane parallel to the front face 21 and back face 22 of the body 2 is herein referred to as an "LT plane," a plane parallel to the end faces 23 and 24 as a "WT plane," and a plane parallel to the top face 25 and bottom face 26 as an "LW plane."

In the coil component 1 according to this embodiment, the body 2 includes a first magnetic layer 6 containing a substantially spherical metallic magnetic material and a second magnetic layer 71 and a third magnetic layer 72 both containing a substantially flat metallic magnetic material.

First Magnetic Layer

The first magnetic layer 6 contains a substantially spherical metallic magnetic material and no substantially flat metallic magnetic material. Owing to the absence of a substantially flat metallic magnetic material in the first magnetic layer 6, the risk of short-circuiting between the outer electrodes (hereinafter simply referred to as "short-circuiting") and failed plating is low. As used herein, the term "substantially spherical" means that the aspect ratio of particles of the metallic magnetic material, defined as the ratio of the major axis a to the minor axis b (a/b), is about 1 or more and about 10 or less (i.e., from about 1 to about 10), and "substantially flat" means that the aspect ratio (a/b) of particles of the metallic magnetic material is about 50 or more and about 150 or less (i.e., from about 50 to about 150). Besides the substantially spherical metallic magnetic material, the first magnetic layer 6 contains a resin material. The first magnetic layer 6 may be a layer of a composite of the substantially spherical metallic magnetic material and resin material. The relative permeability of the first magnetic layer 6 is about 15 or more, preferably about 20 or more, and more preferably about 30 or more.

The substantially spherical metallic magnetic material can be made from any metallic material having magnetism. Examples include iron, cobalt, nickel, gadolinium, and alloys containing one or more than one of them. Preferably, the metallic magnetic material is iron or an iron alloy. The iron may be in its pure form or be a derivative, such as a complex. The ion derivative can be of any type, but examples include iron carbonyls (iron-CO complexes), and a preferred example is iron pentacarbonyl. Hard-grade iron carbonyls in the onion-skin structure (each particle formed by concentric layers; an example is BASF's hard-grade iron carbonyls) are particularly preferred. The iron alloy can be of any type, but examples include Fe—Ni alloy, Fe—Si—Al alloy, Fe—Si alloy, Fe—Co alloy, Fe—Cr alloy, Fe—Cr—Al alloy, Fe—Cr—Si alloy, Fe-based amorphous alloys, and Fe-based nanocrystalline alloys, with or without a minor component such as B or C. The minor component may be present in any amount, but by way of example, the amount of the minor component can be about 0.1% by weight or more and about 5.0% by weight or less (i.e., from about 0.1% to about 5.0%), preferably about 0.5% by weight or more and about 3.0% by weight or less (i.e., from about 0.5% to about 3.0%). Either one or more than one metallic magnetic material may be used.

In a preferred embodiment, the substantially spherical metallic magnetic material preferably has an average particle diameter of about 0.5 μm or more and about 10 μm or less (i.e., from about 0.5 μm to about 10 μm), more preferably about 1 μm or more and about 5 μm or less (i.e., from about 1 μm to about 5 μm), even more preferably about 1 μm or more and about 3 μm or less (i.e., from about 1 μm to about 3 μm). An average particle diameter of about 0.5 μm or more helps handle the material, and an average particle diameter of about 10 μm or less allows the material to be contained to a higher percent fill than otherwise, giving the first magnetic layer 6 better magnetic properties.

As used herein, the term "average particle diameter" refers to the mean equivalent circular diameter of particles in an SEM (scanning electron microscopic) image of a cross-section of the magnetic layer. The average particle diameter can be obtained by, for example, cutting the coil component 1, imaging multiple (e.g., about five) regions (e.g., about 130 μm×about 100 μm) by SEM, analyzing the SEM image using image analysis software (e.g., Asahi Kasei Engineering A-ZO KUN®) to determine the equivalent circular diameter of about 500 or more particles of the substantially spherical metallic magnetic material, and averaging the results.

The surface of the substantially spherical metallic magnetic material may be covered with a coating of an insulating material (hereinafter also referred to simply as an "insulating coating"). In that case, the insulating coating only needs to cover the surface of the material enough that the insulation between particles of the material is improved. That is, the surface of the substantially spherical metallic magnetic material may be covered partially or completely with the insulating coating. The insulating coating is not limited in shape and may be mesh or a layer. In a preferred embodiment, the percentage area covered with the insulating coating is about 30% or more, preferably about 60% or more, more preferably about 80% or more, even more preferably about 90% or more, in particular about 100%. Covering the surface of the substantially spherical metallic magnetic material with an insulating coating will increase the specific electrical resistance of the inside of the first magnetic layer 6.

The insulating coating is not limited in thickness either, but preferably, its thickness can be about 1 nm or more and about 100 nm or less (i.e., from about 1 nm to about 100 nm), more preferably about 3 nm or more and about 50 nm or less (i.e., from about 3 nm to about 50 nm), even more preferably about 5 nm or more and 30 nm or less (i.e., from about 5 nm to about 30 nm), for example about 10 nm or more and about 30 nm or less (i.e., from about 10 nm to about 30 nm) or about 5 nm or more and about 20 nm or less (i.e., from about 5 nm to about 20 nm). Increasing the thickness of the insulating coating will increase the specific electrical resistance of the first magnetic layer 6, and reducing the thickness of the insulating coating will allow a greater amount of substantially spherical metallic magnetic material to be contained in the first magnetic layer 6, thereby improving the magnetic properties of the first magnetic layer 6 and helping make the first magnetic layer 6 smaller.

The resin material in the first magnetic layer 6 can be of any type, but examples include thermosetting resins, such as epoxy, phenolic, polyester, polyimide, and polyolefin resins. The first magnetic layer 6 may contain only one resin material or may alternatively contain two or more.

In the above embodiment, the substantially spherical metallic magnetic material content of the first magnetic layer 6 can preferably be about 70% by weight or more, more preferably about 80% by weight or more, even more preferably about 90% by weight, of the entire first magnetic layer 6. There is no upper limit, but preferably, the percentage can be about 99.5% by weight or less of the entire first magnetic layer 6.

The percent fill of the substantially spherical metallic magnetic material in the first magnetic layer 6 can preferably be about 40% or more, more preferably about 50% or more, even more preferably 60% or more, yet more preferably about 70% or more. There is no upper limit, but the percent fill can be about 95% or less, about 90% or less, about 85% or less, or about 80% or less. Increasing the percent fill of the substantially spherical metallic magnetic material in the first magnetic layer 6 will increase the magnetic permeability of the first magnetic layer 6, further improving the inductance.

As used herein, the term "percent fill" refers to the percentage area of particles in an SEM image of a cross-section of the magnetic layer. The percent fill can be obtained by, for example, cutting the coil component 1 near its middle using a wire saw (e.g., Meiwafosis DWS 3032-4) to expose substantially the middle of an LT plane. The resulting cross-section is subjected to ion milling (e.g., Hitachi High-Technologies Ion Milling System IM4000) to remove the undercut and obtain a cross-section for observation. Multiple (e.g., about five) regions (e.g., about 130 μm×about 100 μm) of the cross-section are imaged by SEM, and the SEM image is analyzed using image analysis software (e.g., Asahi Kasei Engineering A-ZO KUN®) to determine the percentage area of the substantially spherical metallic magnetic material in the regions.

In an embodiment, the first magnetic layer 6 may contain particles of an extra substance. By adding particles of an extra substance, the fluidity of the magnetic layer during its formation can be adjusted.

Second and Third Magnetic Layers

The second magnetic layer 71 and third magnetic layer 72 contain a substantially flat metallic magnetic material. A substantially spherical metallic magnetic material may optionally be contained. Besides the substantially flat metallic magnetic material, the second and third magnetic layers 71 and 72 contain a resin material. The second and third magnetic layers 71 and 72 may be layers of a composite of the substantially flat metallic magnetic material and resin material. The relative permeability of the second and third magnetic layers 71 and 72 is about 40 or more, preferably about 60 or more, more preferably about 80 or more.

The substantially flat metallic magnetic material can be made from any metallic material having magnetism and may be made from a material mentioned above as an example for the substantially spherical metallic magnetic material contained in the first magnetic layer 6. The composition of the substantially flat metallic magnetic material in the second and third magnetic layers 71 and 72 may be the same as or different from that of the substantially spherical metallic magnetic material in the second and third magnetic layers 71 and 72

In a preferred embodiment, the substantially flat metallic magnetic material preferably has an average particle diameter of about 1 μm or more and about 200 μm or less (i.e., from about 1 μm to about 200 μm), more preferably about 5 μm or more and about 100 μm or less (i.e., from about 5 μm to about 100 μm), even more preferably about 10 μm or more and about 70 μm or less (i.e., from about 10 μm to about 70 μm). An average particle diameter of about 10 μm or more helps handle the material, and an average particle diameter of about 70 μm or less allows the material to be contained to a higher percent fill than otherwise, giving the magnetic layers better magnetic properties. The length of the minor axis is preferably about 0.12 μm or more and about 7 μm or less (i.e., from about 0.12 μm to about 7 μm), more preferably about 0.12 μm or more and about 5 μm or less (i.e., from about 0.12 μm to about 5 μm). The length of the major axis is preferably about 30 μm or more and about 200 μm or less (i.e., from about 30 μm to about 200 μm), for example about 40 μm or more and about 90 μm or less (i.e., from about 40 μm to about 90 μm).

The surface of the substantially flat metallic magnetic material may be covered with an insulating coating. The shape and thickness of the insulating coating may be similar to those of the insulating coating when the insulating coating is formed on the substantially spherical metallic magnetic material described above. In the related art, not forming this insulating coating results in a higher magnetic permeability but tends to encourage short-circuiting and failed plating because of a low specific electrical resistance. The coil component 1 according to this embodiment, however, is less likely to suffer short-circuiting and failed plating by virtue of the presence of a magnetic layer containing a substantially spherical metallic magnetic material (first magnetic layer 6) between magnetic layers containing a substantially flat metallic magnetic material (second and third magnetic layers 71 and 72) and the outer electrodes 4 and 5. This allows the manufacturer to prevent short-circuiting and failed plating while improving the magnetic permeability by using a substantially flat metallic magnetic material with no insulating coating thereon.

The resin material contained in the second and third magnetic layers 71 and 72 can be of any type and may be a material mentioned above as an example for the first magnetic layer 6. The composition of the resin material contained in the second and third magnetic layers 71 and 72 may be the same as that of the resin material in the first magnetic layer 6 or different.

In the above embodiment, the substantially flat metallic magnetic material content of each of the second and third magnetic layers 71 and 72 can preferably be about 70% by weight or more, more preferably about 80% by weight or more, even more preferably about 90% by weight, of the entire second or third magnetic layer 71 or 72. There is no upper limit, but preferably, the percentage can be about 99.5% by weight or less of the entire second or third magnetic layer 71 or 72.

The percent fill of the substantially flat metallic magnetic material in each of the second and third magnetic layers 71 and 72 can preferably be about 30% or more, more preferably about 50% or more, even more preferably 60% or more, yet more preferably 70% or more. There is no upper limit, but the percent fill can be about 80% or less, about 75% or less, about 70% or less, or about 65% or less. Increasing the percent fill of the substantially flat metallic magnetic material in the second and third magnetic layers 71 and 72 will increase the magnetic permeability of the second and third magnetic layers 71 and 72, further improving the inductance.

In an embodiment, the second and third magnetic layers 71 and 72 may contain particles of an extra substance. By adding particles of an extra substance, the fluidity of the magnetic layers during their formation can be adjusted. The composition of the second magnetic layer 71 and that of the third magnetic layer 72 may be the same or different.

The second and third magnetic layers 71 and 72 are positioned so that at least the wound section of the coil conductor 3 is between the second and third magnetic layers 71 and 72 in the direction along the axis of the coil conductor 3. The substantially flat metallic magnetic material, contained in the second and third magnetic layers 71 and 72, is oriented so that the flat plane thereof is perpendicular to the axis of the coil conductor 3. A substantially flat metallic magnetic material has greater magnetic permeability in its flat plane owing to morphological anisotropy. As used herein, the term "flat plane" refers to the plane of the substantially flat metallic magnetic material that includes the major axis. By virtue of the substantially flat metallic magnetic material in the second and third magnetic layers 71 and 72 oriented so that its flat plane is perpendicular to the axis of the coil conductor 3, the flat plane of the material is parallel to the magnetic flux passing through the second and third magnetic layers 71 and 72. This parallelism between the highly permeable flat plane and magnetic flux improves the inductance of the coil component 1. As defined above, the aspect ratio of the substantially flat metallic magnetic material is about 50 or more and about 150 or less (i.e., from about 50 to about 150). An aspect ratio in this range results in high magnetic permeability and a high inductance value.

In the coil component 1 according to this embodiment, the first magnetic layer 6 extends between the second and third magnetic layers 71 and 72 and the outer electrodes 4 and 5. The first magnetic layer 6 contains a substantially spherical metallic magnetic material and does not contain a substantially flat metallic magnetic material. A magnetic layer containing a substantially spherical metallic magnetic material tends to have a higher specific electrical resistance than a magnetic layer that contains a substantially flat metallic magnetic material. This means that when the second and third magnetic layers 71 and 72 abut the outer electrodes 4 and 5, there may be a high risk of short-circuiting and failed plating. In the coil component 1 according to this embodiment, the first magnetic layer 6, containing a substantially spherical metallic magnetic material, which has a low specific electrical resistance, and extending between the second and third magnetic layers 71 and 72 and the outer electrodes 4 and 5, prevents direct contact of the outer electrodes 4 and 5 with the second and third magnetic layers 71 and 72. This separation of the outer electrodes 4 and 5 from the second and third magnetic layers 71 and 72 helps prevent short-circuiting and failed plating, such as unwanted plating spread during the formation of the outer electrodes.

In the direction perpendicular to the axis of the coil conductor 3, the second and third magnetic layers 71 and 72 have a width equal to or larger than the outer diameter of the wound section of the coil conductor 3. As used herein, the term "outer diameter of the wound section" refers to the diameter of the wound section's circumference, formed by the side 18 of the coil conductor 3. Preferably, the width of the second and third magnetic layers 71 and 72 in the direction perpendicular to the axis of the coil conductor 3 is equal to the outer diameter of the wound section of the coil conductor 3 as in FIG. 3. In such an arrangement, the substantially flat metallic magnetic material is deployed efficiently near the coil conductor 3 on the top face 25 and bottom face 26 sides of the body 2, where magnetic flux is concentrated. As a result, the inductance is improved efficiently.

In the coil component 1 according to this embodiment, it is preferred that at least one of the surfaces of the body 2 perpendicular to the axis of the coil conductor 3 (i.e., top and bottom faces 25 and 26) be part of the first magnetic layer 6. In such a configuration, the second and third magnetic layers 71 and 72, both containing a substantially flat metallic magnetic material, are spaced sufficiently apart from the outer electrodes 4 and 5, and, as a result, short-circuiting and failed plating are more effectively prevented. In the configuration illustrated in FIG. 3, both surfaces of the body 2 perpendicular to the axis of the coil conductor 3 (top and bottom faces 25 and 26) are part of the first magnetic layer 6. This configuration further reduces the risk of short-circuiting and failed plating.

In the coil component 1 according to this embodiment, it is preferred that at least one of the second and third magnetic layers 71 and 72 be inside the body 2. In such a configuration, the second and third magnetic layers 71 and 72, both containing a substantially flat metallic magnetic material, are sufficiently spaced apart from the outer electrodes 4 and 5, and, as a result, short-circuiting and failed plating are prevented more effectively. In the configuration illustrated in FIG. 3, both the second and third magnetic layers 71 and 72 are inside the body 2. This configuration further reduces the risk of short-circuiting and failed plating.

Preferably, the second and third magnetic layers 71 and 72 are inside the body 2 with the entire outside of the body 2 being part of the first magnetic layer 6 as in FIG. 3. In such a configuration, the second and third magnetic layers 71 and 72, having a low specific electrical resistance, are not exposed outside the body 2. This results in an even longer clearance between the outer electrodes 4 and 5 and the second and third magnetic layers 71 and 72, and, as a result, short-circuiting and failed plating are prevented even more effectively.

In the configuration illustrated in FIG. 3, both the second and third magnetic layers 71 and 72 are inside the body 2, and the width of the second and third magnetic layers 71 and 72 in the direction perpendicular to the axis of the coil conductor 3 is equal to the outer diameter of the wound section of the coil conductor 3. The configuration in FIG. 3 is more efficient at improving the inductance and more effective in preventing short-circuiting and failed plating than otherwise.

The second magnetic layer 71 preferably abuts the end face 16 of the coil conductor 3. Likewise, the third magnetic layer 72 preferably abuts the end face 17 of the coil conductor 3. Such an arrangement deploys the substantially flat metallic magnetic material efficiently in the high-flux-density regions near the coil conductor 3 and therefore is more efficient at improving the inductance.

In a preferred embodiment, the first magnetic layer 6 extends outside the second and third magnetic layers 71 and 72 in the direction along the of the coil conductor 3. The portion of the first magnetic layer 6 extending outside the second and third magnetic layers 71 and 72 in this case has a thickness of preferably about 20 μm or more, more preferably about 80 μm or more, and preferably about 140 μm or less. In FIG. 3, the character "T" denotes the thickness of the portion of the first magnetic layer 6 extending outside the second magnetic layer 71 by way of example. A thickness of about 20 μm or more, more preferably about 80 μm or more, in this portion of the first magnetic layer 6 results in a high specific electrical resistance of the outside of the body 2, on which the outer electrodes 4 and 5 are formed, and therefore provides more effective prevention of short-circuiting and failed plating. A thickness of about 140 μm or more in this portion of the first magnetic layer 6 allows the manufacturer to fabricate the coil component 1 in a small size while preventing short-circuiting and failed plating.

Coil Conductor

The coil conductor 3 is embedded in the body 2, and at least the wound section of the coil conductor 3 is between the second and third magnetic layers 71 and 72 in the direction along the axis of the coil conductor 3. In this embodiment, the coil conductor 3 is positioned with its axis aligned with the direction from top to bottom of the body 2 as illustrated in FIGS. 2 and 3. The ends 14 and 15 of the coil conductor 3 extend to the end faces 23 and 24 of the body 2 and are electrically coupled to the outer electrodes 4 and 5.

The coil conductor 3 can be made from any conductive material, but examples include gold, silver, copper, palladium, and nickel. Preferably, the conductive material is copper. The coil conductor 3 may contain only one conductive material or may alternatively contain two or more.

The coil component 3 can be formed from a wire, a conductive paste, or a foil of a conductive material, but forming it from a wire is preferred because this reduces the direct-current resistance of the coil component 1. The wire may be a round wire or a flat wire, but a flat wire is preferred. A flat wire is easier to wind leaving no space between windings.

In an embodiment, the wire forming the coil conductor 3 is preferably coated with an insulating substance. Coating the wire forming the coil conductor 3 with an insulating substance provides securer insulation between the coil conductor 3 and the magnetic layers, improving the reliability of the coil component 1. Naturally, the points of contact with the outer electrodes 4 and 5 are exposed, with no insulating substance thereon.

The insulating substance can be of any type, but examples include polyurethane, polyester, epoxy, and polyamide-imide resins. Preferably, the insulating substance is a polyamide-imide resin.

The coil conductor 3 itself can also be of any type. Examples include alpha-wound, edgewise-wound, spiral, and helical coil conductors. When the coil component 3 is formed from a wire, alpha or edgewise winding is preferred as it helps reduce the size of the component. In the coil component 1 illustrated in FIG. 2, the coil conductor 3 is an alpha-wound one. In a preferred embodiment, the coil conductor 3 may be an alpha-wound flat wire.

In an embodiment, the coil conductor 3 is positioned with its end faces 16 and 17 at equal distances from the top face 25 and bottom face 26, respectively, of the body 2. This improves the overall inductance by making the entire body 2 contribute more equally to the inductance.

Outer Electrodes

The outer electrodes 4 and 5 are disposed on the outside of the body 2 and electrically coupled to the ends 14 and 15, respectively, of the coil conductor 3.

In an embodiment, the outer electrodes 4 and 5 are substantially L-shaped electrodes (two-surface electrodes) formed on part of the end faces 23 and 24, respectively, and bottom face 26 of the body 2 of the coil component 1 as illustrated in FIGS. 1 and 3. In another embodiment, the outer electrodes 4 and 5 may be bottom electrodes, formed on part of only the bottom face 26 of the body 2 of the coil component 1. Forming the outer electrodes 4 and 5 on the outside of the body 2 as substantially L-shaped or bottom electrodes will prevent short-circuiting between the coil component 1 and any component positioned above, such as an enclosure or an shield, when the coil component 1 is mounted on a substrate or something similar.

In yet another embodiment, the outer electrodes 4 and 5 may be five-surface electrodes formed on part of the end faces 23 and 24, front face 21, back face 22, top face 25, and bottom face 26 of the body 2 of the coil component 1.

The outer electrodes 4 and 5 are made from a conductive material, preferably one or more metallic materials selected from Au, Ag, Pd, Ni, Sn, and Cu. The outer electrodes 4 and 5 may be single-layer or may be multilayer. In an embodiment, multilayer outer electrodes 4 and 5 may include a layer containing Ag or Pd, a layer containing Ni, or a layer containing Sn. In a preferred embodiment, the outer electrodes 4 and 5 are composed of a layer containing Ag or Pd, a layer containing Ni, and a layer containing Sn, preferably in this order from the coil conductor 3 side. The Ag- or Pd-containing layer is preferably a layer of baked Ag or Pd paste (i.e., thermoset layer), and the Ni-containing and Sn-containing layers may be plating layers.

The outer electrodes 4 and 5 are not limited in thickness, but by way of example, their thickness can be about 1 μm or more and about 20 μm or less (i.e., from about 1 μm to about 20 μm), preferably about 5 μm or more and about 10 μm or less (i.e., from about 5 μm to about 10 μm).

In another embodiment, a protective layer may cover the coil component 1 except the outer electrodes 4 and 5. Forming a protective layer will prevent short-circuiting with another electronic component when the coil component 1 is mounted on a substrate or something similar.

The insulating material from which the protective layer is made can be, for example, a resin material with good electrical insulation. Examples include acrylic, epoxy, and polyimide resins.

Fabrication of Coil Components

The following describes a method for fabricating coil components 1. First, multiple coil conductors 3 are placed in a mold. A sheet for the first magnetic layer 6 is laid over the coil conductors 3, and first press forming is performed. The first press forming makes the side 18 of the coil conductors 3 embedded in the sheet for the first magnetic layer 6 and the space inside the coil conductors 3 filled with part of the first magnetic layer 6.

The sheet with the coil conductors 3 embedded therein is removed from the mold. A sheet for the second magnetic layer 71 is laid over one side of the coil conductors 3, on which one end face 16 is exposed, and second press forming is performed with a sheet for the first magnetic layer 6 on this sheet. Then a sheet for the third magnetic layer 72 is laid over the other side of the coil conductors 3, on which the other end face 17 is exposed, and third press forming is performed with a sheet for the first magnetic layer 6 on this sheet. This gives a collective coil substrate including multiple bodies 2. The sheets for the first, second, and third magnetic layers 6, 71, and 72 are joined together as a result of the third press forming, forming the bodies 2 of coil components 1.

The orientation of the substantially flat metallic magnetic material in the sheets for the second and third magnetic layers 71 and 72, incidentally, can be controlled by using known techniques as needed. For example, forming a melt mixture of the resin material and substantially flat metallic magnetic material into a sheet and applying shear force to the sheet in the direction parallel to its major surfaces makes the flat plane of the magnetic material oriented in this direction. A magnetic field may be applied in addition to the shear force.

The collective coil substrate, obtained in the third press forming, is divided into separate bodies 2. On the end faces 23 and 24 of each resulting body 2, the ends 14 and 15, respectively, of the coil conductor 3 are exposed.

Then outer electrodes 4 and 5 are formed on predetermined areas of each body 2, for example by plating, preferably electrolytic plating.

In a preferred embodiment, the areas on the outside of the body 2 for the formation of the outer electrodes 4 and 5 are irradiated with a laser before the plating. Irradiating the outside of the bodies 2 removes at least part of the resin material as a component of the magnetic layer, exposing the metallic magnetic material. The electrical resistance of the outside of the body 2 is reduced, helping plate these areas.

In this way, coil components 1 according to this embodiment are fabricated.

It is to be noted that this is not the only possible method for fabricating a coil component according to this embodiment. A partially modified method may be used, or even a totally different method can be used.

Variation 1

Figure 4:
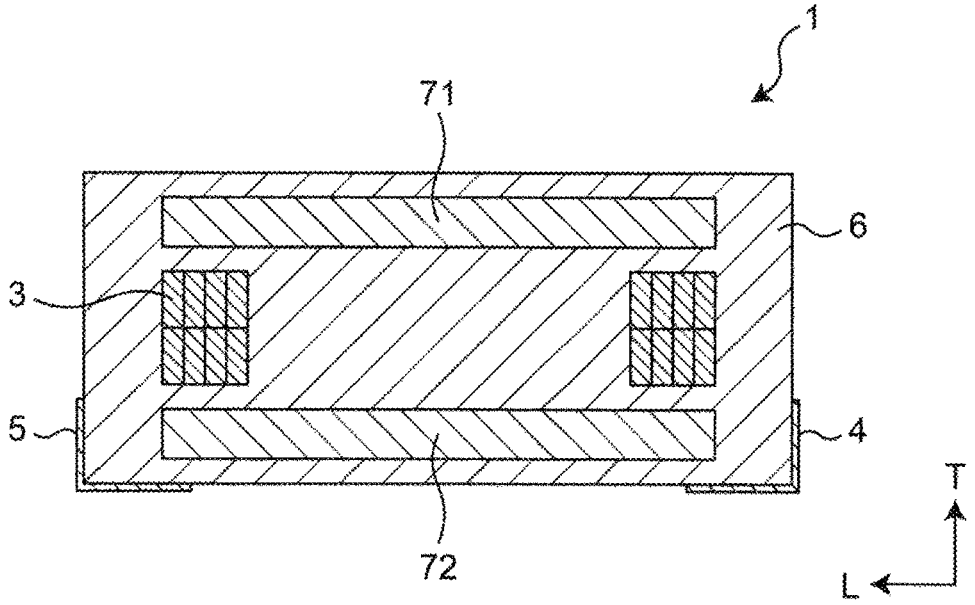
FIG. 4 is a cross-sectional view of Variation 1 of a coil component according to an embodiment of the present disclosure.

The following describes variations of a coil component 1 according to an embodiment of the present disclosure. FIG. 4 is a cross-sectional view of Variation 1 of a coil component according to an embodiment of the present disclosure. In this variation, compared with the configuration in FIG. 3, the first magnetic layer 6 extends between the second and third magnetic layers 71 and 72 and the coil conductor 3, too. Even such a configuration as in FIG. 4, in which the second and third magnetic layers 71 and 72 are spaced apart from the coil conductor 3, prevents short-circuiting and failed plating while improving the inductance like the configuration illustrated in FIG. 3.

Variation 2

Figure 5:
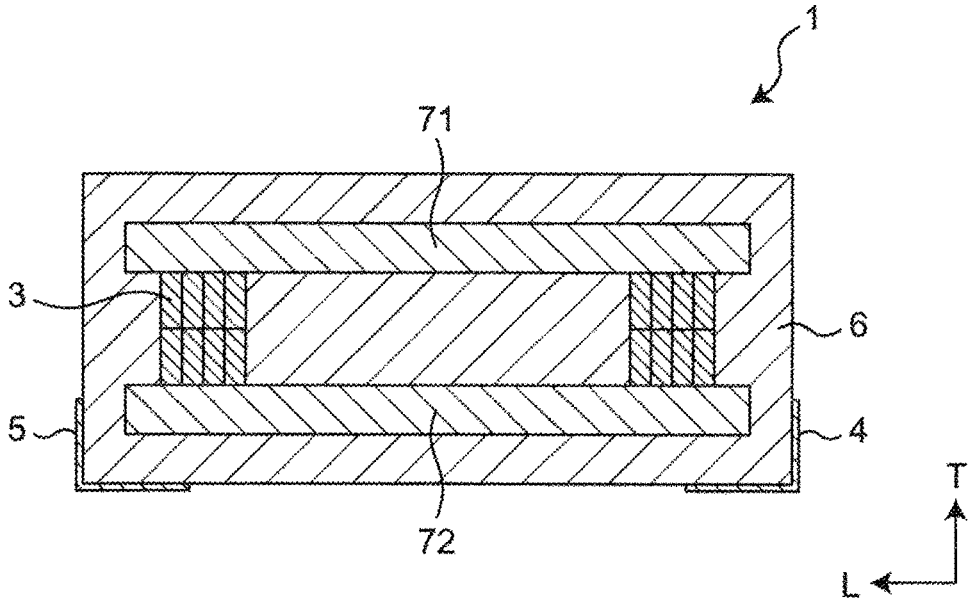
FIG. 5 is a cross-sectional view of Variation 2 of a coil component according to an embodiment of the present disclosure.

FIG. 5 is a cross-sectional view of Variation 2 of a coil component according to an embodiment of the present disclosure. In this variation, compared with the configuration in FIG. 3, the width of the second and third magnetic layers 71 and 72 is larger than the outer diameter of the wound section of the coil conductor 3. Even such a configuration prevents short-circuiting and failed plating while improving the inductance. Note that although the second and third magnetic layers 71 and 72 in FIG. 5 touches the end faces 16 and 17, respectively, of the coil conductor 3, there may be part of the first magnetic layer 6 between the second and third magnetic layers 71 and 72 and the coil conductor 3.

Variation 3

Figure 6:
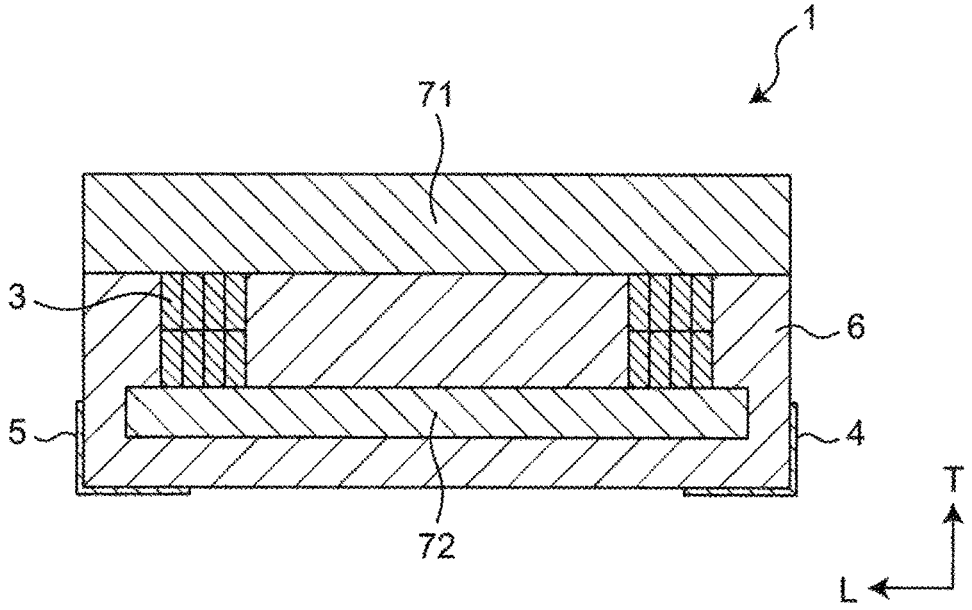
FIG. 6 is a cross-sectional view of Variation 3 of a coil component according to an embodiment of the present disclosure.

FIG. 6 is a cross-sectional view of Variation 3 of a coil component according to an embodiment of the present disclosure. In this variation, compared with the configuration in FIG. 3, the surface of the body 2 perpendicular to the axis of the coil conductor 3 and having no outer electrode thereon is part of the second or third magnetic layer 71 or 72. In FIG. 6, the top face 25 of the body 2, on which there is no outer electrode, is part of the second magnetic layer 71. When the outer electrodes 4 and 5 are substantially L-shaped electrodes as in FIG. 6, the side of the body 2 with no outer electrode thereon can be a magnetic layer containing a substantially flat metallic magnetic material. This magnetic layer is spaced apart from the outer electrodes 4 and 5 and, therefore, does not affect the insulation resistance between the outer electrodes 4 and 5. Coil components according to this variation are easy to fabricate and even better in terms of inductance. Note that although the second and third magnetic layers 71 and 72 in FIG. 6 touches the end faces 16 and 17, respectively, of the coil conductor 3, there may be part of the first magnetic layer 6 between the second and third magnetic layers 71 and 72 and the coil conductor 3. Moreover, although in this variation the width of the third magnetic layer 72 is larger than the outer diameter of the wound section of the coil conductor 3, it may be equal to the outer diameter of the wound section of the coil conductor 3.

Variation 4

Figure 7:
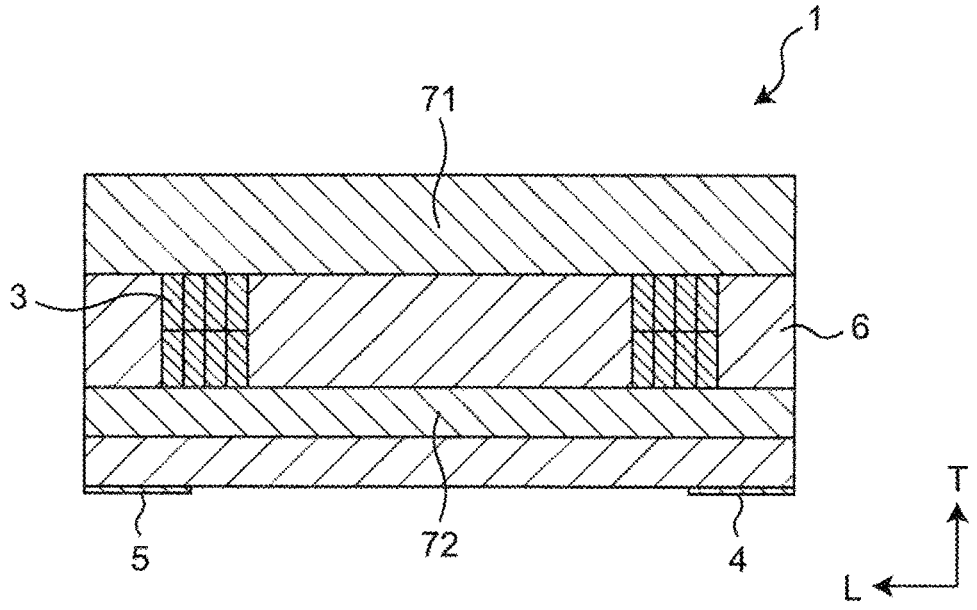
FIG. 7 is a cross-sectional view of Variation 4 of a coil component according to an embodiment of the present disclosure.

FIG. 7 is a cross-sectional view of Variation 4 of a coil component according to an embodiment of the present disclosure. In this variation, compared with the configuration in FIG. 3, the surface of the body 2 perpendicular to the axis of the coil conductor 3 and having no outer electrode thereon is part of the second or third magnetic layer 71 or 72. In FIG. 7, the top face 25 of the body 2, on which there is no outer electrode, is part of the second magnetic layer 71. Moreover, the second and third magnetic layers 71 and 72 are exposed on both end faces 23 and 24 of the body 2. The outer electrodes 4 and 5 in this variation are bottom electrodes. When bottom outer electrodes are used, it is sufficient that only the surface of the body 2 on which the outer electrodes 4 and 5 are formed (bottom face 26 of the body 2) is part of the first magnetic layer 6, which contains no substantially flat metallic magnetic material. This gives an adequate clearance between the outer electrodes 4 and 5 and the second and third magnetic layers 71 and 72, ensuring that short-circuiting and failed plating are prevented satisfactorily. Coil components according to this variation are easy to fabricate and even better in terms of inductance. Note that although the second and third magnetic layers 71 and 72 in FIG. 7 touches the end faces 16 and 17, respectively, of the coil conductor 3, there may be part of the first magnetic layer 6 between the second and third magnetic layers 71 and 72 and the coil conductor 3.

Variation 5

Figure 8:
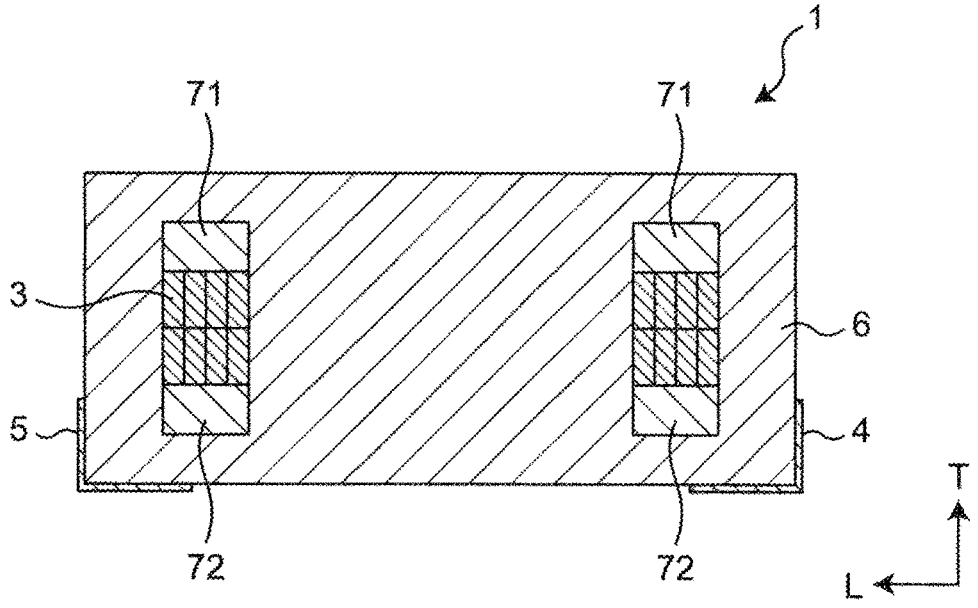
FIG. 8 is a cross-sectional view of Variation 5 of a coil component according to an embodiment of the present disclosure.

FIG. 8 is a cross-sectional view of Variation 5 of a coil component according to an embodiment of the present disclosure. In this variation, compared with the configuration in FIG. 3, the second and third magnetic layers 71 and 72 extend only where they overlap the coil conductor 3 in the direction along the axis of the coil conductor 3. This variation is efficient in improving the inductance because the substantially flat metallic magnetic material is deployed only near the end faces 16 and 17 of the coil conductor 3, where magnetic flux is concentrated. Note that although the second and third magnetic layers 71 and 72 in FIG. 8 touches the end faces 16 and 17, respectively, of the coil conductor 3, there may be part of the first magnetic layer 6 between the second and third magnetic layers 71 and 72 and the coil conductor 3.

Variation 6

Figure 9:
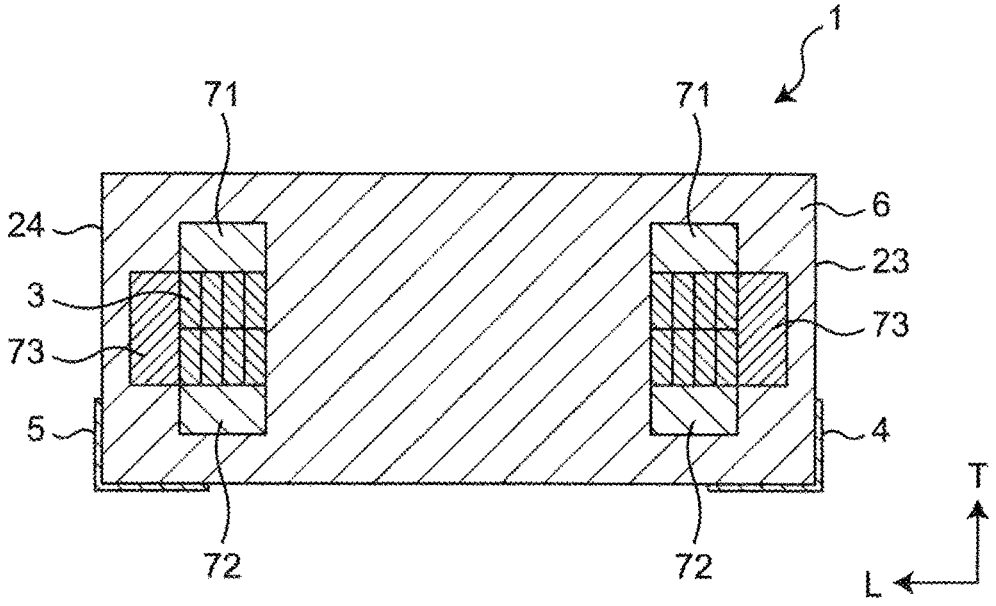
FIG. 9 is a cross-sectional view of Variation 6 of a coil component according to an embodiment of the present disclosure.

FIG. 9 is a cross-sectional view of Variation 6 of a coil component according to an embodiment of the present disclosure. In this variation, compared with Variation 5, the body 2 has a fourth magnetic layer 73 surrounding the wound section of the coil conductor 3. The variations illustrated in FIGS. 3 to 7 and 10, for example, may also include the fourth magnetic layer 73. The fourth magnetic layer 73 contains a substantially flat metallic magnetic material, with the material oriented so that its flat plane is parallel to the axis of the coil conductor 3, and the first magnetic layer 6 extends between the fourth magnetic layer 73 and the outer electrodes 4 and 5. Making a substantially flat metallic magnetic material oriented in such a way in the fourth magnetic layer 73 brings the material's flat plane parallel to the magnetic flux passing through the fourth magnetic layer 73. Forming the fourth magnetic layer 73 further improves the inductance of the coil component 1. Moreover, the first magnetic layer 6 extending between the fourth magnetic layer 73 and the outer electrodes 4 and 5 prevents the insulation resistance between the outer electrodes 4 and 5 from being affected. Note that although the fourth magnetic layer 73 in the configuration in FIG. 9 is entirely inside the body 2, the fourth magnetic layer 73 may be exposed outside the body 2 as long as the clearance from the outer electrodes 4 and 5 is sufficiently long.

Variation 7

Figure 10:
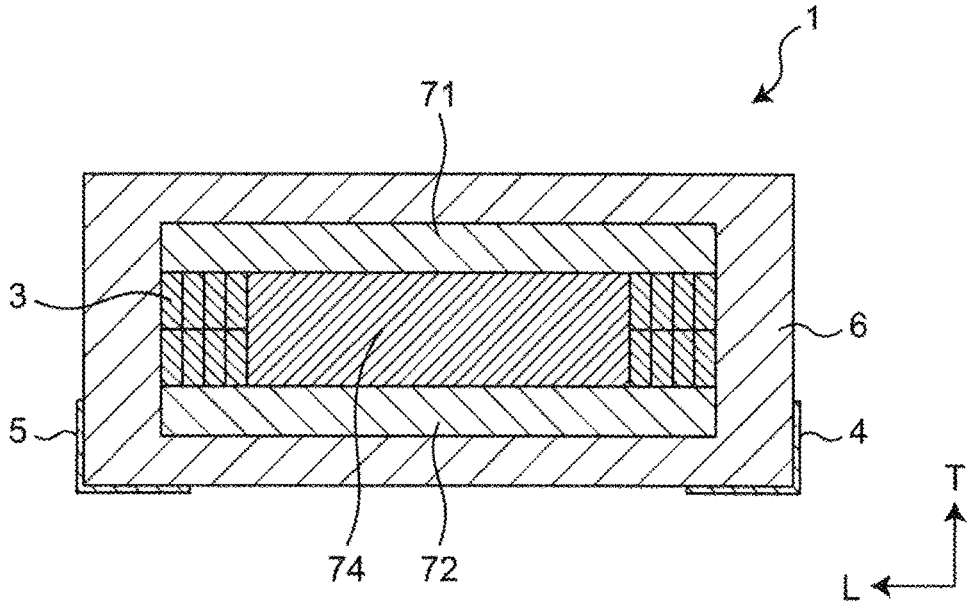
FIG. 10 is a cross-sectional view of Variation 7 of a coil component according to an embodiment of the present disclosure.

FIG. 10 is a cross-sectional view of Variation 7 of a coil component according to an embodiment of the present disclosure. In this variation, compared with the configuration in FIG. 3, the body 2 has a fifth magnetic layer 74 filling the space inside the wound section of the coil conductor 3. The variations illustrated in FIGS. 4 to 9, for example, may also include the fifth magnetic layer 74. The fifth magnetic layer 74 contains a substantially flat metallic magnetic material, with the material oriented so that its flat plane is parallel to the axis of the coil conductor 3, and the first magnetic layer 6 extends between the fifth magnetic layer 74 and the outer electrodes 4 and 5. Making a substantially flat metallic magnetic material oriented in such a way in the fifth magnetic layer 74 brings the material's flat plane parallel to the magnetic flux passing through the fifth magnetic layer 74. Forming the fifth magnetic layer 74 further improves the inductance of the coil component 1. Moreover, the first magnetic layer 6 extending between the fifth magnetic layer 74 and the outer electrodes 4 and 5 prevents the insulation resistance between the outer electrodes 4 and 5 from being affected. Note that although in this variation the width of the second and third magnetic layers 71 and 72 is equal to the outer diameter of the wound section of the coil conductor, it may be larger or smaller than the outer diameter of the wound section of the coil conductor 3. For example, in plan view, or when viewed along the axis of the coil conductor 3, the width of the second and third magnetic layers 71 and 72 along the L direction may be larger than the outer diameter of the wound section of the coil conductor 3 as measured in the L direction so that the ends of the second and third magnetic layers 71 and 72 in the L direction are positioned outward from the side 18 of the coil conductor 3 when viewed from the inside of the wound section of the coil conductor 3. Alternatively, the width of the second and third magnetic layers 71 and 72 may be smaller than the outer diameter of the wound section of the coil conductor 3 so that the second and third magnetic layers 71 and 72 extend only where they overlap the coil conductor 3 in the direction along the axis of the coil conductor 3.

The following describes advantages of a coil component according to an embodiment of the present disclosure in further detail. A substantially flat metallic magnetic material has a higher magnetic permeability in its flat plane with increasing flattening by virtue of morphological anisotropy. In the direction perpendicular to the flat plane, however, the magnetic permeability decreases with increasing flattening of the material. In general, the magnetic permeability of a particle is inversely proportional to the particle's demagnetizing factor, which is determined by the particle's shape. Assume a substantially flat particle of a metallic magnetic material having its flat plane in the xy plane. The direction perpendicular to the flat plane is along the z axis. In this case, the demagnetizing factors in the flat plane (Nd_x and Nd_y) decrease with increasing flattening (aspect ratio), whereas that in the direction perpendicular to the flat plane (Nd_z) increases with increasing flattening (aspect ratio). A substantially flat particle of a metallic magnetic material having an aspect ratio of about 100, by way of example, has a magnetic permeability roughly five times higher than that of a substantially spherical particle of the magnetic material when compared in the effective portion in the direction along the flat plane. The Nd_x and Nd_y of the substantially flat particle is roughly ⅕ of those of the substantially spherical particle. Since the directional demagnetizing factors satisfy the relationship of Nd_z+Nd_y+Nd_z=1, the Nd_z of the substantially flat particle is roughly 3.5 times larger than that of the substantially spherical particle. This means that the vertical permeability of the substantially flat particle is roughly 3/10 of that of the substantially spherical particle.

When a substantially flat metallic magnetic material is used in a coil component, the magnetic field excited by the coil may be applied vertically to the flat plane somewhere in the material. The desired advantage of improved inductance may be lost, depending on the arrangement of the substantially flat metallic magnetic material.

The inventors conducted the following finite-element electromagnetic-field simulation to find a preferred arrangement of the substantially flat metallic magnetic material. The models used are outlined in FIGS. 11A to 11D, and the simulated inductance values are presented in FIG. 11E. FIG. 11D illustrates a structure equivalent to that of the coil component 1 according to an embodiment of the present disclosure illustrated in FIG. 3.

The inductance was compared between the four structures considering the aforementioned vertical permeability of a substantially flat metallic magnetic material, which is the permeability measured in the direction perpendicular to the material's flat plane. With the structure illustrated in FIG. 11B (structure (B); the same applies hereinafter), the inductance was rather low compared with that achieved with structure (A) in FIG. 11A, which used a substantially spherical magnetic material. This is because the direction of the magnetic field is perpendicular to the flat plane, or in the direction in which the magnetic permeability is low, inside and outside the coil. Structure (B) is therefore not appropriate as an arrangement of the substantially flat metallic magnetic material.

Figure 11A:
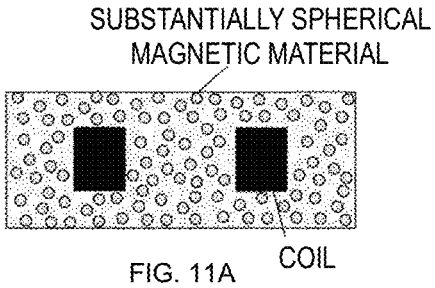
FIGS. 11A to 11E are models used for an inductance simulation and a graph illustrating the simulated inductance values.
Figure 11B:
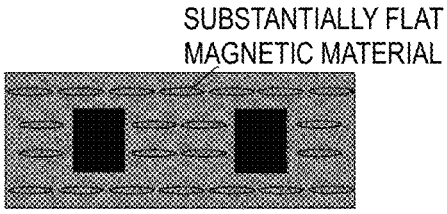
Figure 11C:
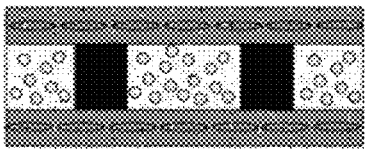
Figure 11D:
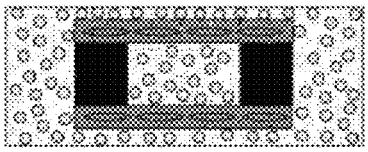
Figure 11E:
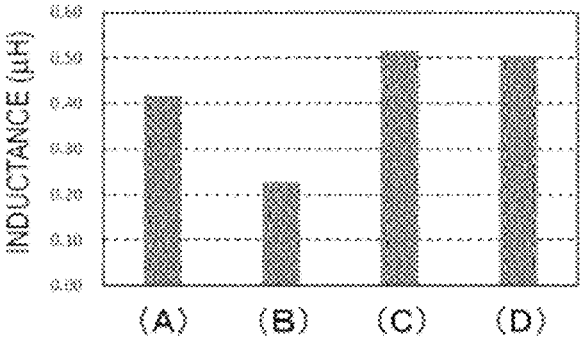

With structures (C) and (D) in FIGS. 11C and 11D, respectively, the inductance was greatly improved compared with that achieved with structure (A). Of these two, structure (C) has the disadvantage of a higher risk of short-circuiting between the outer electrodes because the body's voltage resistance is low on account of both top and bottom faces of the body being part of a magnetic layer containing a substantially flat metallic magnetic material, which has a low specific electrical resistance. In structure (D), by contrast, electrical contact (of a type that produces an electrical circuit) between a layer containing a substantially flat metallic magnetic material layer and an outer electrode is avoided because the entire outside of the body is part of a magnetic layer containing a substantially spherical metallic magnetic material, which has a high specific electrical resistance. In other words, structure (D), which is a structure according to this embodiment, provides a coil component that is less likely to suffer short-circuiting between the outer electrodes and failed plating than structure (C), in which both top and bottom faces of the body are part of a layer containing a substantially flat metallic magnetic material, and is comparable to structure (C) in terms of inductance.

In the following, improved insulation as an advantage of coil components according to this embodiment is described with reference to specific examples of configurations of a coil component according to this embodiment.

Figure 12:
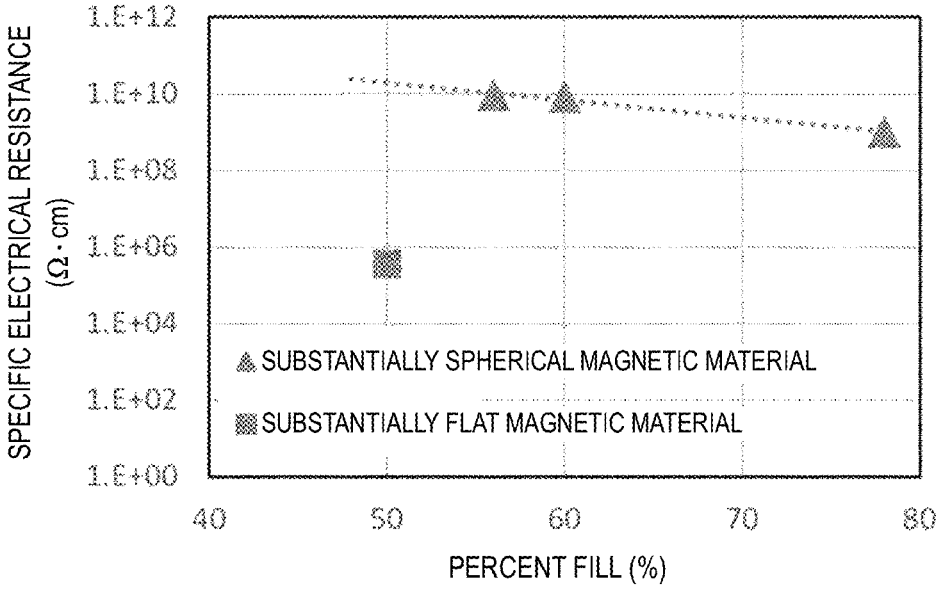
FIG. 12 is a graph illustrating the relationship between percent fill and specific electrical resistance for magnetic materials.

FIG. 12 is a graph illustrating the relationship between percent fill and specific electrical resistance for magnetic materials. In general, a substantially flat metallic magnetic material used as a metallic filler achieves a lower percent fill but a higher magnetic permeability than a substantially spherical form of the magnetic material. At equal fill percentages, a magnetic layer containing a substantially flat metallic magnetic material has a lower specific electrical resistance than a magnetic layer containing a substantially spherical form of the metallic magnetic material.

Figure 13:
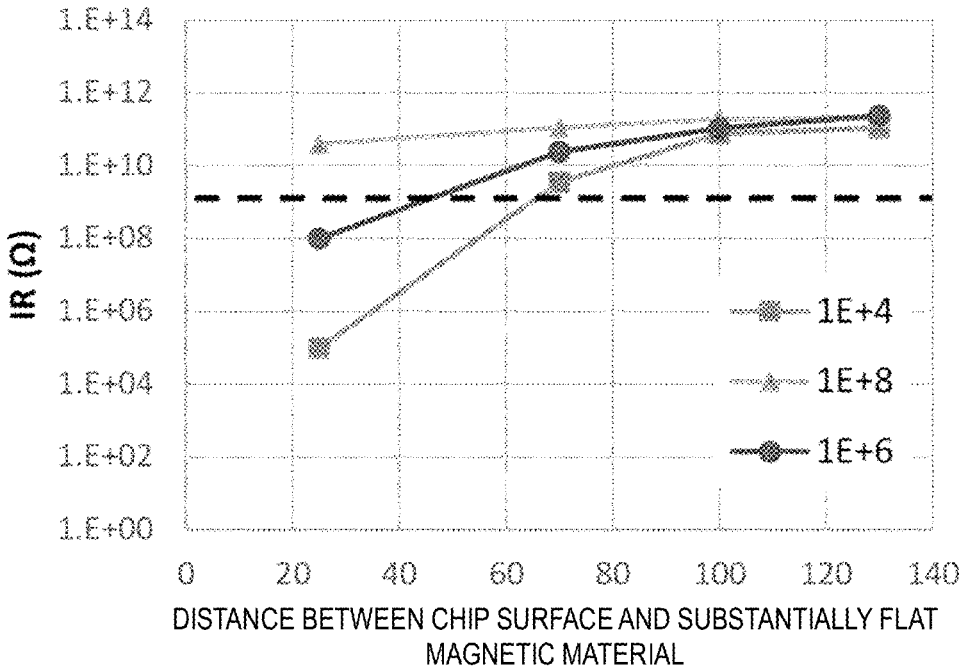
FIG. 13 is a graph illustrating relationships between the distance from a magnetic layer containing a substantially flat metallic magnetic material to the top face of a body and the insulation resistance between outer electrodes.

The inventors calculated the insulation resistance (IR) between outer electrodes for coil components in which layers containing a substantially flat metallic magnetic material were arranged as illustrated in FIG. 3. In the calculations, the distance between the top face of the body and the upper magnetic layer containing a substantially flat metallic magnetic material was varied by changing the thickness of the magnetic layer with the distance between the top face of the body and the upper end face of the coil constant at about 170 μm. The specific electrical resistance of the substantially spherical magnetic material was about $1\times10^9\Omega\cdot$cm, and that of the substantially flat metallic magnetic material ranged from about $1\times10^4$ to about $1\times10^8\Omega\cdot$cm. The results are presented in FIG. 13. As can be seen from FIG. 13, the IR increased with increasing distance between the top face of the body and the layer containing a substantially flat metallic magnetic material. Given the voltage resistance of the body, the IR needs to be on the order of $10^9$ on the outside of the coil component. The configuration used in the calculations can be given the desired IR by setting a distance between the outside of the body and the layer containing a substantially flat metallic magnetic material of about 70 μm or more according to the specific electrical resistance of the magnetic material.

In the event of an external potential difference, moreover, the decrease in dielectric strength is limited by virtue of the more voltage-resistant substantially spherical metallic magnetic material covering the outside of the body. As described in relation to FIGS. 11A to 11E, the advantages of a coil component having the structure illustrated in FIG. 3 are not limited to the smaller decrease in dielectric strength but include a sufficient improvement in inductance. In a coil component, placing a substantially flat metallic magnetic material near the outside of the body only has a comparatively small effect in improving the inductance because the magnetic flux is generated mostly near the coil. Moreover, the magnetic flux in the corners formed by the top or bottom face and sides of the body is oblique (not parallel) with respect to the flat plane of a substantially flat metallic magnetic material placed there. Placing a substantially flat metallic magnetic material in such corners, too, only has a comparatively small effect on the conductance.

While coil components according to an embodiment of the present disclosure have been described above, the present disclosure is not limited to the described embodiment. Changes in design can be made without departing from the spirit of the present disclosure.

For example, the magnetic layers, which are single layers in the coil component 1 according to the described embodiment, may be multilayer bodies obtained by stacking multiple magnetic sheets.

The present disclosure includes, but is not limited to, the following aspects.

Aspect 1

A coil component including a body, a coil conductor embedded in the body, and outer electrodes disposed on outside of the body. The body includes a first magnetic layer containing a substantially spherical metallic magnetic material and second and third magnetic layers containing a substantially flat metallic magnetic material. At least a wound section of the coil conductor is between the second and third magnetic layers in a direction along an axis of the coil conductor. In a direction perpendicular to the axis, the second and third magnetic layers have a width equal to or larger than an outer diameter of the wound section of the coil conductor. The substantially flat metallic magnetic material, contained in the second and third magnetic layers, is oriented so that a flat plane thereof is perpendicular to the axis of the coil conductor. The first magnetic layer extends between the second and third magnetic layers and the outer electrodes.

Aspect 2

Aspect 2 provides the coil component according to Aspect 1, wherein a wire forming the coil conductor is coated with an insulating substance.

Aspect 3

Aspect 3 provides the coil component according to Aspect 1 or 2, wherein at least one surface of the body perpendicular to the axis is part of the first magnetic layer.

Aspect 4

Aspect 4 provides the coil component according to any one of Aspects 1 to 3, wherein at least one of the second and third magnetic layers is inside the body.

Aspect 5

Aspect 5 provides the coil component according to any one of Aspects 1 to 4, wherein the second and third magnetic layers are inside the body, and the entire outside of the body is part of the first magnetic layer.

Aspect 6

Aspect 6 provides the coil component according to any one of Aspects 1 to 5, wherein in the direction along an axis of the coil conductor, the first magnetic layer extends outside the second and third magnetic layers, and outside the second and third magnetic layers the first magnetic layer has a thickness of about 80 μm or more.

Aspect 7

Aspect 7 provides the coil component according to any one of Aspects 1 to 6, wherein in the direction perpendicular to the axis, the width of the second and third magnetic layers is equal to the outer diameter of the wound section of the coil conductor.

Aspect 8

Aspect 8 provides the coil component according to any one of Aspects 1 to 7, wherein the first magnetic layer extends between the second and third magnetic layers and the coil conductor.

Aspect 9

Aspect 9 provides the coil component according to any one of Aspects 1 to 8, wherein the second and third magnetic layers extend only where the second and third magnetic layers overlap the coil conductor in the direction along the axis.

Aspect 10

Aspect 10 provides the coil component according to Aspect 1 or 2, wherein a surface of the body perpendicular to the axis and having no outer electrode thereon is part of the second or third magnetic layer.

Aspect 11

Aspect 11 provides the coil component according to any one of Aspects 1 to 10, wherein the body further includes a fourth magnetic layer surrounding the wound section of the coil conductor; the fourth magnetic layer contains a substantially flat metallic magnetic material, with the substantially flat metallic magnetic material therein oriented so that a flat plane thereof is parallel to the axis; and the first magnetic layer extends between the fourth magnetic layer and the outer electrodes.

Aspect 12

Aspect 12 provides the coil component according to any one of Aspects 1 to 11, wherein the body further includes a fifth magnetic layer filling space inside the wound section of the coil conductor; the fifth magnetic layer contains a substantially flat metallic magnetic material, with the substantially flat metallic magnetic material therein oriented so that a flat plane thereof is parallel to the axis; and the first magnetic layer extends between the fifth magnetic layer and the outer electrodes.

Coil components according to preferred embodiments of the present disclosure can have a wide variety of applications, for example as an inductor.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising a body, a coil conductor embedded in the body, and outer electrodes disposed on outside of the body, wherein:

the body includes a first magnetic layer containing a substantially spherical metallic magnetic material, and second and third magnetic layers containing a substantially flat metallic magnetic material;

at least a wound section of the coil conductor is between the second and third magnetic layers in a direction along an axis of the coil conductor;

in a direction perpendicular to the axis, the second and third magnetic layers have a width equal to or larger than an outer diameter of the wound section of the coil conductor;

the substantially flat metallic magnetic material, contained in the second and third magnetic layers, is oriented so that a flat plane thereof is perpendicular to the axis of the coil conductor; and the second and third magnetic layers are spaced apart from the outer electrodes.

2. The coil component according to claim 1, wherein a wire forming the coil conductor is coated with an insulating substance.

3. The coil component according to claim 1, wherein at least one surface of the body perpendicular to the axis is part of the first magnetic layer.

4. The coil component according to claim 1, wherein at least one of the second and third magnetic layers is inside the body.

5. The coil component according to claim 1, wherein:

the second and third magnetic layers are inside the body; and an entire outside of the body is part of the first magnetic layer.

6. The coil component according to claim 1, wherein:

in the direction along the axis of the coil conductor, the first magnetic layer extends outside the second and third magnetic layers; and outside the second and third magnetic layers the first magnetic layer has a thickness of about 80 μm or more.

7. The coil component according to claim 1, wherein in the direction perpendicular to the axis, the width of the second and third magnetic layers is equal to the outer diameter of the wound section of the coil conductor.

8. The coil component according to claim 1, wherein the first magnetic layer extends between the second and third magnetic layers and the coil conductor.

9. The coil component according to claim 1, wherein the second and third magnetic layers extend only where the second and third magnetic layers overlap the coil conductor in the direction along the axis.

10. A coil component comprising a body, a coil conductor embedded in the body, and outer electrodes disposed on outside of the body, wherein:

the body includes a first magnetic layer containing a substantially spherical metallic magnetic material, and second and third magnetic layers containing a substantially flat metallic magnetic material;

at least a wound section of the coil conductor is between the second and third magnetic layers in a direction along an axis of the coil conductor;

in a direction perpendicular to the axis, the second and third magnetic layers have a width equal to or larger than an outer diameter of the wound section of the coil conductor;

the substantially flat metallic magnetic material, contained in the second and third magnetic layers, is oriented so that a flat plane thereof is perpendicular to the axis of the coil conductor;

the first magnetic layer extends between the second and third magnetic layers and the outer electrodes; and a surface of the body perpendicular to the axis and having no outer electrode thereon is part of the second or third magnetic layer.

11. The coil component according to claim 1, wherein:

the body further includes a fourth magnetic layer surrounding the wound section of the coil conductor;

the fourth magnetic layer contains a substantially flat metallic magnetic material, with the substantially flat metallic magnetic material therein oriented so that a flat plane thereof is parallel to the axis; and the first magnetic layer extends between the fourth magnetic layer and the outer electrodes.

12. The coil component according to claim 1, wherein:

the body further includes a fifth magnetic layer filling space inside the wound section of the coil conductor;

the fifth magnetic layer contains a substantially flat metallic magnetic material, with the substantially flat metallic magnetic material therein oriented so that a flat plane thereof is parallel to the axis; and the first magnetic layer extends between the fifth magnetic layer and the outer electrodes.

13. The coil component according to claim 2, wherein at least one surface of the body perpendicular to the axis is part of the first magnetic layer.

14. The coil component according to claim 2, wherein at least one of the second and third magnetic layers is inside the body.

15. The coil component according to claim 2, wherein:

the second and third magnetic layers are inside the body; and an entire outside of the body is part of the first magnetic layer.

16. The coil component according to claim 2, wherein in the direction perpendicular to the axis, the width of the second and third magnetic layers is equal to the outer diameter of the wound section of the coil conductor.

17. The coil component according to claim 2, wherein the first magnetic layer extends between the second and third magnetic layers and the coil conductor.

18. The coil component according to claim 2, wherein the second and third magnetic layers extend only where the second and third magnetic layers overlap the coil conductor in the direction along the axis.

19. The coil component according to claim 2, wherein a surface of the body perpendicular to the axis and having no outer electrode thereon is part of the second or third magnetic layer.

20. A coil component comprising a body, a coil conductor embedded in the body, and outer electrodes disposed on outside of the body, wherein:

the body includes a first magnetic layer containing a substantially spherical metallic magnetic material, and second and third magnetic layers containing a substantially flat metallic magnetic material;

at least a wound section of the coil conductor is between the second and third magnetic layers in a direction along an axis of the coil conductor;

in a direction perpendicular to the axis, the second and third magnetic layers have a width equal to or larger than an outer diameter of the wound section of the coil conductor;

the substantially flat metallic magnetic materials, contained in the second and third magnetic layers, is oriented so that a flat plane thereof is perpendicular to the axis of the coil conductor;

the first magnetic layer extends between the second and third magnetic layers and the outer electrodes; and each of the second and third magnetic layers is positioned directly adjacent to the coil conductor or is positioned adjacent to the coil conductor with only the first magnetic layer in between the coil conductor and each of the second and third magnetic layers.

* * * * *